United States Patent [19]

Trepaud

[11] 4,058,161

[45] Nov. 15, 1977

[54] HEAT EXCHANGER

[76] Inventor: Georges Trepaud, 1, Rond-Point Bugeaud, 75016-Paris, France

[21] Appl. No.: 602,905

[22] Filed: Aug. 7, 1975

[30] Foreign Application Priority Data

Dec. 5, 1974 France ..... 74.39813

[51] Int. Cl.[2] ..... F28D 7/10; F20F 9/22; F28F 5/00

[52] U.S. Cl. ..... 165/158; 165/162; 122/510

[58] Field of Search ..... 122/32, 34, 510; 165/162

[56] References Cited

U.S. PATENT DOCUMENTS

| | | | |
|---|---|---|---|
| 1,992,504 | 2/1935 | Penniman | 165/162 X |
| 3,147,743 | 9/1964 | Romano | 122/32 |
| 3,212,570 | 10/1965 | Holman | 165/162 |
| 3,336,974 | 8/1967 | Bernstein et al. | 165/162 X |
| 3,626,481 | 12/1971 | Taylor | 165/162 |
| 3,782,455 | 1/1974 | Wolowodiuk | 165/162 |
| 3,916,990 | 11/1975 | Ruhe et al. | 165/162 X |

FOREIGN PATENT DOCUMENTS

| | | | |
|---|---|---|---|
| 732,163 | 9/1932 | France | 165/162 |

*Primary Examiner*—C. J. Husar
*Assistant Examiner*—Theophil W. Streule, Jr.
*Attorney, Agent, or Firm*—Robert E. Burns; Emmanuel J. Lobato; Bruce L. Adams

[57] ABSTRACT

A heat exchanger comprising an outer heavy structure in the form of an outer cylindrical shell fixed at its upper end to an annular intake head and an annular outlet head for one of the fluids, of which the outer bases are perforated, and an inner lightweight structure subsequently mounted in the heavy structure and formed by an annular nest of tubes inserted and welded at their ends into the perforations in said bases and arranged in the form of concentric layers forming a large central passage which is accessible for installation of the tubes, beginning with the peripheral layer adjacent the outer shell, the concentric layers of tubes being held in several transverse planes by discs formed by concentric rows of rings arranged between these layers and joined together by connecting elements, a wide central shaft subsequently being fixed for internally defining the annular exchange chamber, wherein the discs by which the tubes are held in position and which are formed by the concentric rings are in some cases, free to rotate about the axis of the apparatus under the effect of the flexural deformation of the tubes attributable to their expansion and in other cases, are fixed and joined to the outer shell and, optionally, to the central shaft which internally closes the annular exchange chamber occupied by the nest of tubes.

3 Claims, 9 Drawing Figures

HEAT EXCHANGER

FIELD OF THE INVENTION

This invention relates to a heat-exchanger.

BACKGROUND TO THE INVENTION

Our U.S. patent application Ser. No. 523,891 now U.S. Pat. No. 3,989,105, describes a multiple-tube heat exchanger which is particularly suitable for use as a steam generator and in which the primary heat-carrying fluid is formed by the cooling fluid (pressurized water or liquid sodium) of a nuclear reactor. The exchanger described in the parent patent comprises, in combination, an outer heavy structure in the form of an outer cylindrical shell fixed at its upper end to an annular intake head and an annular outlet head for one of the fluids, of which the inner bases are perforated, and an inner lightweight structure subsequently mounted in the heavy structure and formed by an annular nest of tubes inserted and welded at their ends into the perforations in said bases and arranged in the form of concentric layers forming a large central passage which is accessible for installation of the tubes, beginning with the peripheral layer adjacent the outer shell, the concentric layers of tubes being held in several transverse planes by discs formed by concentric rows of rings arranged between these layers and joined together by radial stays, a wide central shaft subsequently being fixed for internally defining the annular exchange chamber.

In one embodiment described in earlier Specification, the tubes of the exchanger are all identical and comprise arcuate bends situated successively on either side of the longitudinal axis of the tubes, which provides them with a quasi-sinusoidal form, the retaining planes, in the form of concentric rings joined together by connecting elements allowing through the fluid circulating along and around the tubes, being situated level with the crests of the sinusoids or level with the inflexion points and being joined by welding to the outer cyclindrical shell and to the central shaft.

It will be appreciated that it is possible, by using tubes shaped in this way, to compensate by elastic flexural deformation the differential expansion which can occur between the tubes and the outer shell in view of the fairly significant differences in temperature, which may amount to as much as 200° C, between the tubes and the shell, which would obviously not be the case if the tubes were straight. As indicated in the earlier Specification, the result obtained in this way is a considerable reduction in the stressing which the tubes undergo. However, this method of fixing the tubes has to satisfy two opposing requirements to enable maximum benefit to be derived from the flexibility of the tubes. On the one hand, the manner in which the tubes are fixed should leave them with maximum freedom of expansion, whilst on the other hand the tubes have to be fixed fairly rigidly in order to prevent them from vibrating. In the arrangement described in the earlier Specification, this result was obtained by varying the distance between the rigid retaining planes of the tubes because the tubes can expand more freely, the longer the curve along which their free expansion occurs, whilst widening the intervals between the fixing points involves the danger of vibration of the tubes. Thus, it is extremely difficult to establish a satisfactory compromise between these two opposing requirements. The present invention enables this result to be obtained by simple and effective means.

BRIEF SUMMARY OF THE INVENTION

The improvement which is the subject of the present invention is distinguished by the fact that the discs by which the tubes are held in position and which are formed by the above-mentioned concentric rings are in some cases, free to rotate about the axis of the apparatus under the effect of the flexural deformation of the tubes attributable to their expansion and in other cases, are fixed and joined to the outer shell and, optionally, to the central shaft which internally closes the annular exchange chamber occupied by the nest of tubes.

FURTHER FEATURES OF THE INVENTION

The fixed retaining discs and the retaining discs which are free to rotate about the axis of the apparatus are preferably arranged equidistant from one another in an alternating sequence, the distance between them being selected in such a way that, individually, each tube is perfectly stable, this distance generally being of the order of 1 meter.

In order, on the other hand, to ensure that the undulating tubes are not in any danger of being displaced or of vibrating outside the planes containing the undulations, the tubes may comprise asymmetrical undulations on either side of their general longitudinal axis so that the fixing points of the tubes situated on either side of that axis are situated at different distances therefrom. In one preferred embodiment, however, the fixing points of the tubes which are held in the fixed retaining discs are situated on the general axis of the tubes, whilst the freely rotatable retaining discs are situated at the level of the crests of the undulations situated on one side of this general axis.

The tubes may compise straight sections between undulations situated on one and the same side, in which case the fixed retaining discs are arranged substantially level with the centres of these straight sections.

In another embodiment, the tubes comprise, between two successive unilateral undulations, two very slight, oppositely directed undulations, whilst the fixed retaining discs are situated level with the connecting points of these slight undulations so that the tubes are rigidly held at points situated along their longitudinal axes.

In order, in addition, to improve heat exchange at the point where the water to be vaporized enters the lower part of the exchanger and in its upper part, in which the vapor produced is superheated, means are provided for imparting both to the water and to the steam a transverse flow relative to the tubes through which the heat-carrying fluid passes. To this end, the exchanger comprises, in the lower part and in the upper part of the annular exchange chamber, at least one baffle plate of which the central and marginal zones are respectively formed by retaining rings joined by tubular radial stays separating the tubes from one another and allowing through the fluid circulating around the tubes, and by rings comprising, in their opposite lateral faces, semicircular recesses for receiving the tubes and for preventing axial circulation of the fluid so as to impart to it a transverse flow relative to the tubes, or vice versa.

One embodiment of the heat exchanger according to the present invention is described by way of example in the following with reference to the accompanying drawings, wherein:

BRIEF DESCRIPTION OF DRAWINGS

FIG. 3 is a partial plan view of a retaining disc, of which

DESCRIPTION OF EMBODIMENTS

Figure 1:
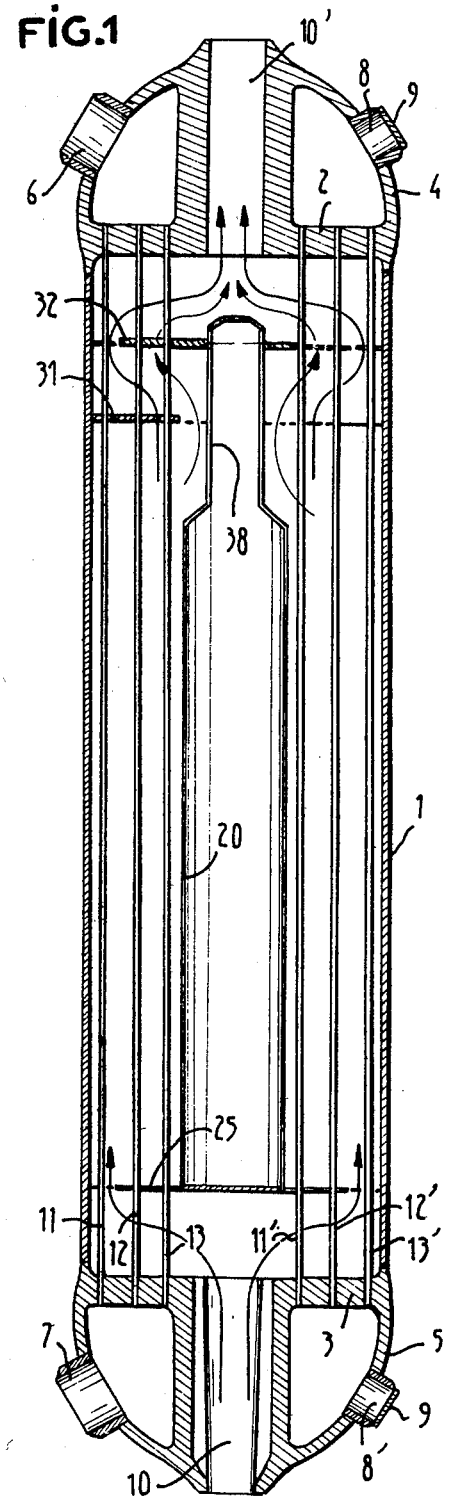
FIG. 1 is an axial section through the exchanger according to the invention.

As mentioned earlier on, the heat exchanger shown in FIG. 1 comprises an outer heavy structure in the form of a cylindrical shell 1 fixed by welding at its two ends to perforated, annular terminal plates 2, 3 and to two annular heads 4, 5 comprising an outer dome-shaped wall and an inner cylindrical wall forming a wide central passage. The heads 4, 5 which are used respectively for the admission and removal of the heat-carrying fluid circulating through the tubes of the nest (in the embodiment illustrated hot pressurised water coming from the cooling circuit of a nuclear reactor), respectively comprise an intake opening 6 and an outlet opening 7 for that fluid, and manholes 8, 8' closed by fluid-tight doors 9, 9'.

The central passage 10 of the lower head 5 are used to admit the water to be vaporized, whilst the superheated steam produced in the exchanger leaves the exchanger through the central passage 10' of the upper head 4.

Figure 2A:
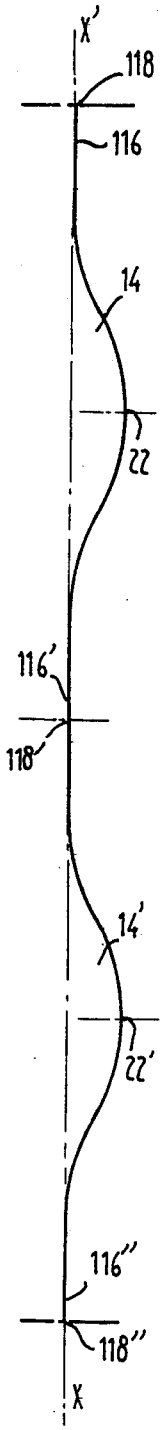
FIG. 2*a* is an elevation of a variant of the tube shown in FIG. 2.
Figure 2:
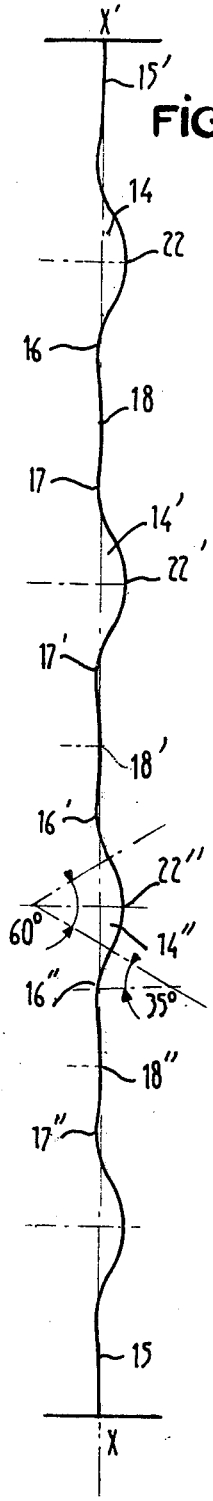
FIG. 2 is an elevation of one tube of this exchanger.

Flexible tubes, all of which have the shape illustrated in FIG. 2, are introduced and welded at their straight ends into perforations in the perforated terminal plates 2, 3.

In the interests of clarity, FIG. 1 shows only two tubes 11, 11' belonging to the outer, circular peripheral layer, two tubes 12, 12' belonging to a layer situated inside the nest of tubes, and two tubes 13, 13' belonging to the inner peripheral layer.

A wide central shaft 20 of thin sheet metal internally closes the annular exchange chamber containing the nest of tubes over the greater part of the height of the apparatus.

As shown in FIG. 2*a*, each tube comprises undulations, such as 14, 14', 14'', situated along one side of the general longitudinal axis X' X of the tube, along which are situated its straight ends 15, 15' which are inserted into the perforated terminal plates. These undulations are in the form of arcuate bends extending over 60° which are joined at their two ends to undulations 16, 16', 17, 17' with a camber 5 to 10 shallower than the preceding undulations, these small undulations extending over 35° and being arranged in pairs, returning to the axis X' X at the points 18, 18'.

Figure 3:
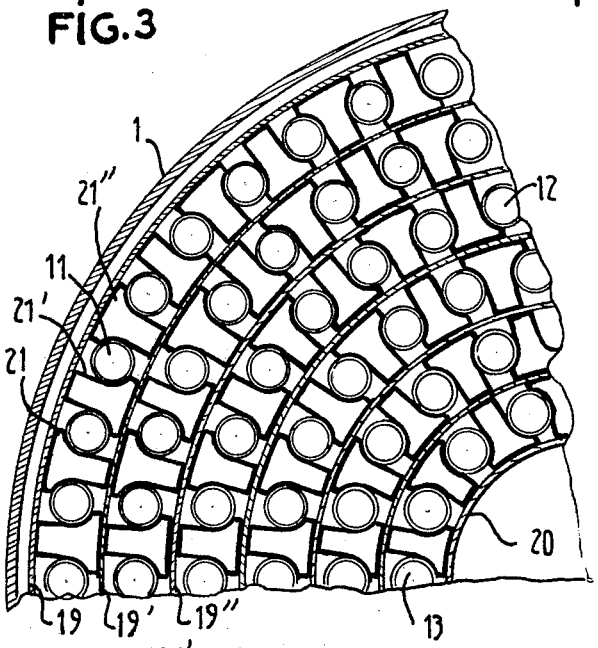

These tubes are held in position by means of rows of concentric rings 19, 19', 19'' as shown in FIG. 3 joined together by tubular stays 21, 21', 21'' with concave lateral walls arranged head-to-tail and separating the tubes from one another whilst, at the same time, holding them firmly in position and leaving a free passage of considerable width for the fluid circulating along the tubes.

These stays are welded through their convex, cylindrical radial surfaces to the inner face of a ring situated outside a layer of tubes and to the outer face of the ring situated inside that layer so that all the rings are held firmly together and form a rigid plate or disc.

These retaining plates or discs are arranged at equal distances from one another on the one hand level with the connecting points 18,18' of the small undulations of the tubes, which are thus held at points situated along their longitudinal axes, and on the other hand level with the crests 22,22',22'' of the major undulations situated on the opposite side to the minor undulations relative to the axis X'X.

The retaining discs arranged level with the points 18,18' are fixed and, to this end, their outer peripheral rings are welded to the inner surface of the cylindrical shell 1. By contrast, the retaining discs situated level with the crests 22,22',22'' of the undulations are not joined to the outer shell 1 and, accordingly, are free to rotate about the longitudinal axis of the apparatus under the effect of the expansions of the tubes which produce an increase in their camber at the crest. Theoretically, the retaining rings forming the mobile plates or discs could have been designed to slide relative to one another which would have enabled all the tubes, irrespective of their position in the nest, to be deformed in the same way. However, this method of retaining the tubes in rings sliding relative to one another would considerably complicate the construction and would involve the danger of reducing the inertia of the assembly, thereby promoting vibration. Accordingly, it is preferable to render these discs rigid and to allow the tubes situated in different layers to undergo equally different deformation, thereby giving rise to different stresses. However, as will be shown hereinafter, these differences in stressing are by no means significant and, in any event, are very much smaller than those to which straight tubes would be subjected.

Figure 4:
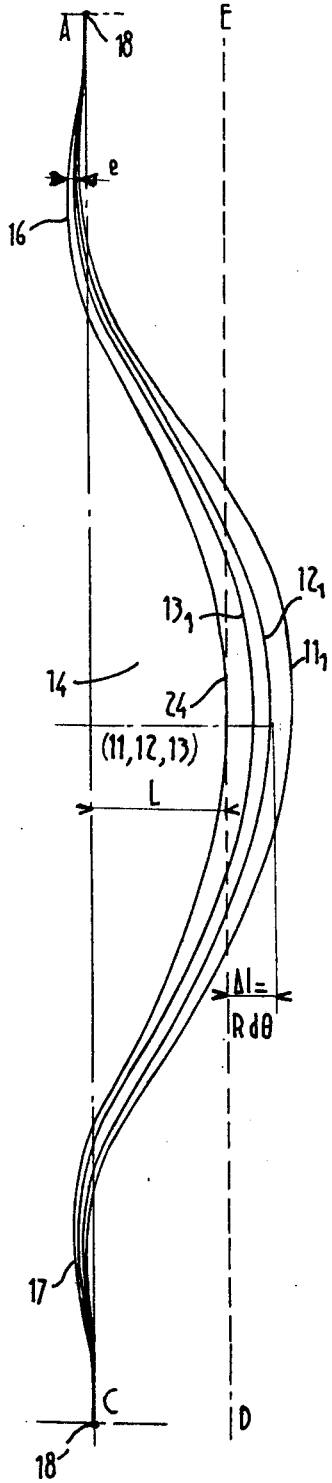
FIG. 4 shows on a larger scale that part of this tube situated between two fixed retaining discs, and the deformation which this tube undergoes at the level of the freely rotatable retaining disc according to whether it is situated at the outer or inner periphery of or inside the nest of tubes.
Figure 5:
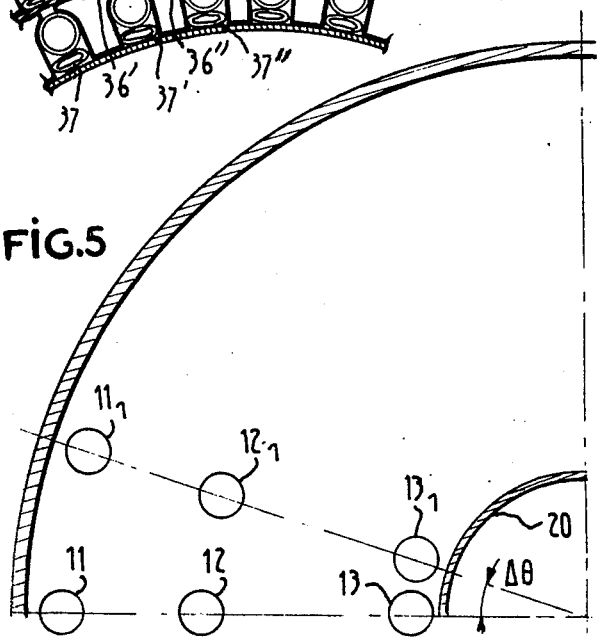
FIG. 5 is a partial cross-section through a nest of tubes showing the displacements of the crests of the undulations of these tubes for a given rotation of the free retaining discs.

These deformations are illustrated in FIGS. 4 and 5 for three tubes situated in the same radial plane, one (11) on the outer periphery of the nest, the second (12) substantially on the middle ring of the nest and the third (13) on the inner periphery. Under the effect of expansion, the cambers of the undulations of the tubes at their crests 22 increase and, hence, tend to cause the retaining disc to turn through an angle $\Delta\theta$ (FIG. 5). Since the disc is rigid, the displacements which the crests 22 of the sinusoids undergo are of necessity different in the different concentric layers. Assuming that the tubes 12 of the middle layer are displaced in a completely free manner, the displacement of the outer peripheral layer will extend over a wider arc, whilst the displacement of the tubes of the inner layer will, by contrast, be restrained, the angle of rotation $\Delta\theta$ of the disc ultimately being determined by the equilibrium of the oppositely directed forces applied to that disc by the tubes situated on either side of the middle layer.

In FIG. 4, the initial form of all the tubes before any expansion is denoted by the reference 24. When, at a given temperature, the mobile retaining disc is turned through the angle $\Delta\theta$, thereby establishing equilibrium, the tubes such as 11 of the outer layer will be deformed into position $\mathbf{11}_1$, the tubes such as 12 of the middle layer will be deformed into position $12_1$ and the tubes such as 13 of the inner peripheral layer will be deformed into position $13_1$. By contrast, the camber of the minor undulations, such as 16 and 16', will be reduced during this deformation to compensate for the increase in length of the tubes due to their expansion.

Stress calculations for tubes made of Inconel 14/16 forming an annular nest with an external diameter of 3.80 meters and an internal diameter of 1.50 meters, produced the following results for a temperature of 280° C of the outer shell, a temperature of 326° C for the tubes and a pressure of 172 bars prevailing inside the tubes:

for the tubes of the middle layer 12, the displacement of the crests of the undulations amounts to 5.62 mm and the total stressing to 15.76 kg/mm², for the tubes of the outer peripheral layer 11, the displacement of the crests of the undulations amounts to 7.31 mm and the total stressing to 15.9 kg/mm², and for the tubes of the inner peripheral layer 13, the displacement of the crests of the undulations amounts to 2.81 mm and the total stressing to 15.53 kg/mm².

It can be seen that the total stressing varies relatively little from one layer to the other of the nest of tubes, which fully justifies the use of rigid mobile retaining discs, turning in a single piece, at the level of the crests of the undulations of the tubes.

The stresses indicated above are very much lower than the permitted values normally specified. A comparable result could also be obtained, if necessary, for greater temperature differences between the tubes and the outer shell.

It is pointed out that, in certain cases, the shape of the tubes could be simplified. Instead of shallow undulations directed oppositely to the major undulations, the major undulations could be joined together by straight sections disposed along the general longitudinal axis X'X of the tubes, the fixed retaining discs being disposed substantially at the centre of these straight sections. In this case, the differential deformations at the crests of the undulations would be compensated by more or less considerable deflection of the straight sections (it is pointed out that the shallow curves 16, 17 are designed to prevent possible deformation of the straight section which could be slightly curved in the wrong direction.)

FIG. 2*a* shows by way of modification a tube comprising, as indicated above, straight sections 116, 116', 116" between the unilateral undulations 14, 14'. In this case, it would be possible, for example, to provide three mobile retaining rings disposed at the crests 22, 22' of the undulations 14, 14' and at the centre 118' of the straight section which separates them between two fixed retaining rings disposed at the middle points 118 and 118" of the two straight sections situated outside the undulations 14, 14'. This arrangement enables the flexibility of the tubes to be increased in the event of very considerable differences in temperature.

As indicated in the earlier specification, the undulating form of the tubes enables the heat transfer coefficient to be improved, without increasing the overall height of the apparatus, in order to obtain superheated steam in the upper part of the apparatus. In addition, the transfer of heat is considerably increased at the same time as the rate of circulation around the tubes.

In order further to improve heat transfer, the invention provides means which enable a transverse flow relative to the tubes as close as possible to the perpendicular direction thereof to be established both in the heating zone and in the superheating zone. These means are in the form of baffle plates which are made similarly to the retaining discs described above, except that they are solid over at least part of their surface. In this way, it is possible to control the direction of the superheated steam and its rate of flow which has to be very high on account of the low thermal conductivity of superheated steam.

As shown in FIG. 1, a baffle plate 25 of the kind referred to above is arranged in the lower part of the exchanger above the central inlet 10 for the water to be vaporised, this baffle plate being solid over the greater part of its surface and only allowing water to flow through around its outer peripheral section so as to induce below the plate a transverse flow relative to the tubes indicated by the arrows.

Figure 6:
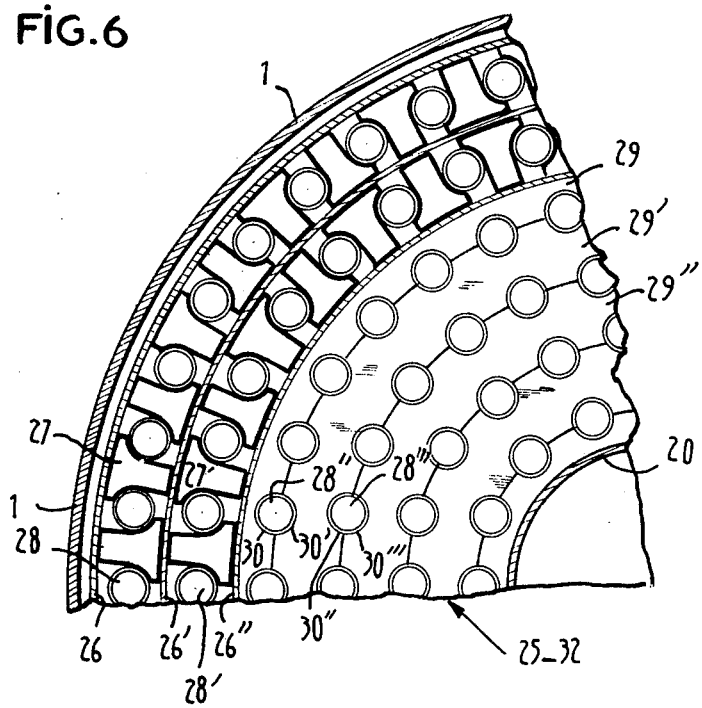
FIGS. 6 and 7 are partial plan views of two baffle plates.

A plan view of this plate 25 is shown in FIG. 6 which shows that, around its outer peripheral section, the plate is similar to the retaining plates or discs shown in FIG. 3 in the form of concentric rings 25, 26', 26" joined together by welded tubular stays 27, 27', 27" separating the tubes of the concentric layers 28,28' from one another. By contrast, the rest of the surface of the plate is formed by thicker rings 29, 29', 29" welded directly together and comprising in their opposite surfaces semicylindrical recesses 30, 30', 30" in which the tubes of the concentric layers 28", 28"' are accommodated with minimum play.

In one modification, the retaining rings forming the solid zone of the baffle plate 31 or 32 are identical with those 26 of the open zone, the flow of steam being blocked in this zone by flat sections, for example in the form of flat circular segments which are formed with circular holes for the passages of the tubes and which are placed on or, optionally, welded to the rings 26.

Figure 7:
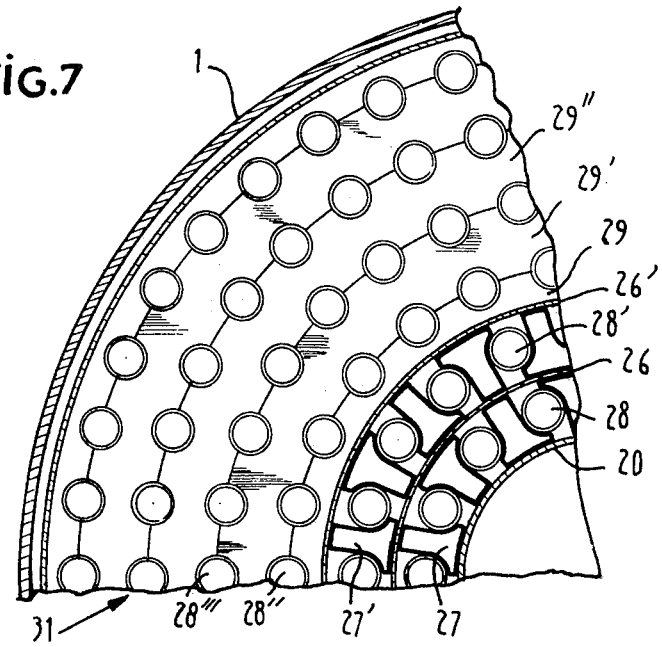

In its upper part, i.e., in the superheating zone, the apparatus comprises two baffle plates 31, 32, of which the first, shown in FIG. 7, is arranged oppositely to that illustrated in FIG. 6 in such a way that it allows steam through in its zone adjacent the central shaft, whilst the second is arranged in the same way as that shown in FIG. 6 in such a way that it allows the steam through in its outer peripheral zone. As a result, the steam flows transversely of the tubes from inside to outside between the two plates 31 and 32 and from outside to inside between the plate 32 and the steam outlet 10'.

These baffle plates, of which the number may be different from those quoted by way of example above, contribute towards retaining the tubes and, like the retaining discs, may be fixed by connection to the outer shell of the exchanger, or free to rotate about the axis of the apparatus, according to whether they are situated at the level of the crests of the major undulations of the tubes or at the level of those points of these tubes which are situated on the longitudinal axis of the tubes between these undulations.

These baffle plates, in the form of concentric rings of two different types, are assembled in the same way as the retaining discs by introduction through the central passages in the heads of the outer structure and by positioning them from the periphery towards the outside as the tubes of the nest are installed.

In order not to reduce the throughflow cross-section of the steam in the zone of the baffle plates 31, 32 to any significant extent, the diameter of the corresponding part 38 of the central shaft 20 is reduced which provides for transverse circulation of the steam without substantially increasing its rate of flow and, hence, without reducing the exchange coefficient.

Figure 3A:
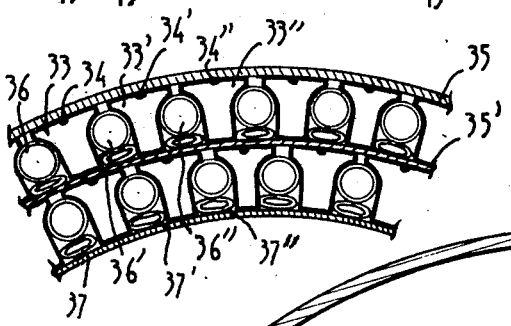
FIG. 3*a* shows a variant.

The fixed and mobile retaining discs and those parts of the baffle plates which allow the fluid to flow through, may have the modified configuration illustrated in FIG. 3*a*. In this variant, all the tubular stays, such as 33, 33', 33'' . . . have the same form as those shown in FIGS. 3, 6 and 7, but are all arranged in the same direction rather than head-to-tail, and are welded in advance by their major convex surfaces to the points 34, 34', 34'' . . . only on the inner face of the outer ring 35 of the row of tubes 36, 36', 36'' . . . This arrangement has several advantages:

the distance between two consecutive stays is clearly defined so that the play between the tubes and their mountings may be defined, for installation, each tube has a clearly defined recess so that it is easier to position, the stays are welded in advance to the elements forming the retaining rings.

In order, in this modification, to improve the stability of the tubes, optionally tubular shims 37, 37', 37'' are inserted between two adjacent tubular stays, the tube arranged between these two shims and the inner retaining ring, as shown in FIG. 3*a*.

I claim:

1. A heat exchanger comprising, an outer heavy structure including an outer cylindrical shell having fixed thereon an upper head having an outer wall and an inner coaxial wall defining an annular chamber therein and a large central passage, an annular base plate closing the lower end of said chamber and having a plurality of circular rows of perforations, a lower annular head fixed on said shell constructed similarly to the upper head and arranged symmetrically relative thereto whereby its inner coaxial wall defines a large central through passage allowing access to the interior of said structure, each head being provided with an aperture for flow of a fluid, axially through said shell, and a light inner structure comprising an annular bundle of alike axially undulated tubes each having quasi-sinusoidal undulations have successive arcuate deflections relative to the longitudinal axis thereof and spaced axially on the tubes with straight sections of the tubes therebetween, said tubes being arranged in a plurality of concentric circles and having upper and lower ends in the perforations of corresponding annular base plates of said heads and welded thereto, a closed central tubular shaft internally of said bundle of tubes secured to said bundle of tubes and extending less than the axial distance between the base plate of the upper head and that of said lower head and defining with said shell a heat exchange chamber in which said bundle of tubes is disposed, a series of annular radially spaced supporting rings arranged as supporting discs on different axially spaced supporting planes intermediate the deflections on said tubes respectively, paired concentric rings in each supporting disc being arranged on either side of each circle of tubes, a plurality of radially extending tubular stays each inserted between a pair of adjacent tubes in a common circle and welded to the outer and to the inner rings of each pair of paired rings respectively to firmly maintain said tubes without contact between the tubes and the rings, means for securing the peripheral outer rings of each supporting disc at each supporting plane to the inner surface of the outer shell, another series of annular, radially spaced, rings arranged as mobile retaining discs on different axially spaced planes tangential with the crests of the deflections of said tubes and free to move angularly about the longitudinal axis of said shell, each mobile retaining disc comprising paired concentric rings arranged on either side of each circle of tubes and a plurality of radially extending tubular stays, each stay being disposed between a pair of adjacent tubes in a common circle and welded to the outer and to the inner ring of each pair of rings respectively to maintain said tubes without contact between the tubes and the rings, and said tubes being arranged with said deflections in a common direction for expanding and rotating said mobile discs angularly in a common direction about the longitudinal axis of said shell.

2. A heat exchanger according to claim 1, including means for securing the peripheral outer ring of said supporting discs to said central tubular shaft.

3. A heat exchanger according to claim 1, including baffles in a lower part and a lower part of the annular heat exchange chamber and disposed transversely thereof, said baffles controlling axial and transverse flow of said fluid through said heat exchange chamber and each comprising a plurality of retaining rings and a plurality of stays arranged similarly to the retaining rings and stays of said supporting discs and retaining mobile discs along an annular radial sector thereof, and having concentric contiguous, solid annular plates along a remainder annular sector thereof with perforations through which said tubes extend with some clearance circumferentially thereof, whereby the solid annular plates of each baffle define a transverse solid sector preventing in use axial flow of the fluid flowing axially through said solid sector and impart a flow direction to said fluid transversely of said heat exchange chamber and the first-mentioned radial sector allows axial flow therethrough.

* * * * *